United States Patent [19]

Tai et al.

[11] Patent Number: 5,046,980

[45] Date of Patent: Sep. 10, 1991

[54] TOY DEVICE WITH PULL-OUT BIB

[75] Inventors: Woon S. Tai, North Point, Hong Kong; Rita Raiffe, Edison, N.J.

[73] Assignee: Gund, Inc., Edison, N.J.

[21] Appl. No.: 485,742

[22] Filed: Feb. 27, 1990

[51] Int. Cl.[5] ..... A63H 3/00; A63H 33/00; A41B 13/10

[52] U.S. Cl. ..... 446/73; 446/27; 446/227; 2/49 R

[58] Field of Search ..... 446/73, 72, 71, 74, 446/76, 26, 27, 28, 227; 2/46, 49 R

[56] References Cited

U.S. PATENT DOCUMENTS

| | | | |
|---|---|---|---|
| D. 155,712 | 10/1949 | Kingson | 446/72 X |
| 1,118,707 | 11/1914 | Wakefield | 446/73 X |
| 2,078,809 | 4/1937 | Richman | 446/74 |
| 2,591,379 | 4/1952 | Schradermeier | 446/74 X |
| 3,010,110 | 11/1961 | Kirk | 2/49 R |
| 3,699,704 | 10/1972 | Hakim | 446/227 |
| 4,236,263 | 12/1980 | Allee | 446/72 X |
| 4,715,840 | 12/1987 | Swift | 446/74 |
| 4,723,323 | 2/1988 | Wright, Jr. . | |
| 4,754,512 | 7/1988 | Chao-Yang | 446/73 X |
| 4,829,601 | 5/1989 | Spanier | 446/26 X |
| 4,884,299 | 12/1989 | Rose | 2/49 R |

FOREIGN PATENT DOCUMENTS

| | | | |
|---|---|---|---|
| 1560609 | 3/1969 | France | 2/49 R |

*Primary Examiner*—David N. Muir
*Attorney, Agent, or Firm*—Gottlieb, Rackman & Reisman

[57] ABSTRACT

A toy device comprising a container and a handle attached to the container. A bib formed of sheet material is located within the hollow interior of the container, with one end portion of the bib being fixed within the container. The container has an opening and the bib may be selectively extended through the opening and outwardly of the container. When the bib is situated within the container, the toy device may be carried by a child via the handle as an amusement. When the handle is fixed about the neck of a child, the bib can be readily withdrawn from the container through the opening and then can be located over the chest of the child, thereby preventing spoilage when the child eats or drinks food.

27 Claims, 3 Drawing Sheets

TOY DEVICE WITH PULL-OUT BIB

BACKGROUND OF THE INVENTION

This invention relates to a toy device comprising a hollow container, handle means attached to the container and a bib formed of sheet material having an end portion fixed within the container and being extendable through an opening in the container outwardly from the container and being rollable back into the container.

Bibs for use by children are of course well known and serve to prevent food or drink from soiling the clothes being worn by a young child. However, when a family leaves its home and travels to a restaurant, often there is no convenient place to store such a bib while in route or at the restaurant. The bib gets lost among the many other items which are taken by the child's parents to the restaurant for the use by the child, such as pacifiers, nipples, toys and sometimes changes of clothing.

Moreover, it would be desirable to instill a sense of responsibility in a young child by having that child carry his or her own bib from his home to the restaurant. However, a child is unlikely to be careful with a bib of a conventional nature, since it has no play value and is perceived as a device associated with a negative act, the spilling of food or drink and the soiling of clothes.

Accordingly, it would be desirable to provide a bib which is held within a container resembling an animal, which the child would carry from his or her home to a restaurant and which, which once at the restaurant, could be readily transformed into a bib carrying out its traditional protective function.

In accordance with the foregoing purpose, the container has a handle by which the container can be carried by the young child. This handle also serves to retain the container about the neck of the child so that when the bib is pulled out from the container it is located at its desired location over the upper chest area of the child.

SUMMARY OF THE INVENTION

Generally, and in accordance with the present invention, there is provided a toy device including a container having a hollow interior. The container has an elongated opening which can be opened or closed by a zipper. Within the container is stored a bib, with its upper end being fixed within the container. When the zipper is opened and the opening of the container is exposed, the bib can be rolled out through the opening. Since the upper end of the bib is fixed within the container, the bib will stay properly in place, hanging downwardly from the container.

A handle is attached to the container and enables the child to hold the container, especially when the bib is within the interior of the container. The handle readily locates the container at the neck of a young child, so that the bib lies at the chest area of the child, protecting the child's clothes in this area from being soiled by food or drink. When the child is finished eating or drinking, the bib can be rolled back into the container through the opening, and then the opening is once again closed by the zipper.

Thus, it is the primary object of the present invention to provide a toy device which stores in its interior, a bib which can when desired be extended outwardly from the container and which can thereafter be placed back into the container.

It is still another object of the present invention to provide such a toy device which can be carried by a child via a handle and which through the same handle can be attached about the neck of the child.

It is still a further object of the present invention to provide such a toy device which will encourage the child to carry his or her own bib from his or her home to a different location such as a restaurant.

It is still another object of the present invention to provide such a toy device which is made of soft and washable fabric, so that the device will function as an amusing toy and so that the child's parents can readily wash the same if the toy has become soiled.

Still other objects of the invention will be apparent from the detailed description.

The present invention accordingly comprises the toy device embodying the features of construction, combinations of elements and arrangements of parts as exemplified in the following detailed disclosure, with the scope of the invention being indicated in the appended claims.

DRAWINGS

With reference to the appended drawings.

DETAILED DESCRIPTION OF THE PREFERRED EMBODIMENT

Referring first to the preferred embodiment of the present invention, shown in FIGS. 1 through 6 hereof, there is shown a toy device generally indicated at 10 of a type that would be attractive and amusing to a young child and would be considered as a plaything.

Figure 4:
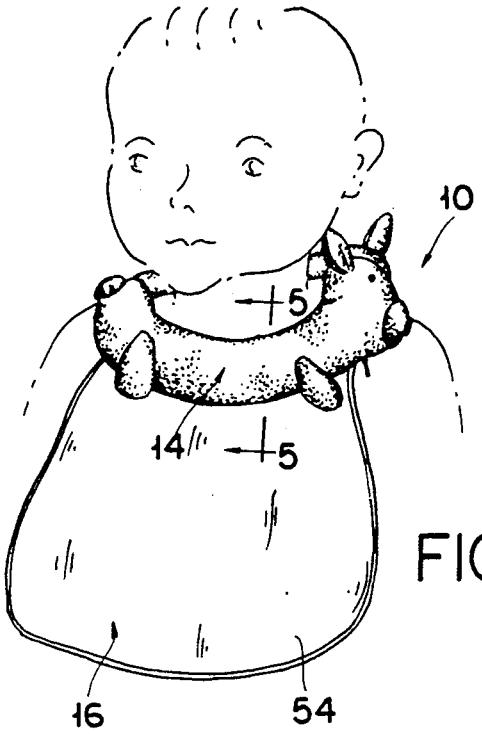
FIG. 4 is a view of the toy device of the present invention engaged about the neck of a child, with the bib hanging from the toy device container and being in its extended position protecting the chest area of a young child.

The toy device 10 comprises three main components, namely a handle 12, a container 14 and a bib 16. Referring to the handle 12 initially, it will be seen that the same includes, in a preferred embodiment, a pair of straps 18, 20 of substantially equal length. Straps 18, 20 are desirably formed of tubular fabric, and are selectively joined at their adjacent ends by a detachable snap means 21, comprising a female snap member 22 and a male snap member 24, which are joinable and detachable in a conventional fashion. The other, distant ends of straps 18, 20 are attached to container 14 at the ends of such container as by conventional sewing. Straps 18, 20 are sized to be readily grasped by the hand of a child, as shown in FIG. 2, and to fit about the neck of a child, as shown in FIG. 4.

Figure 1:
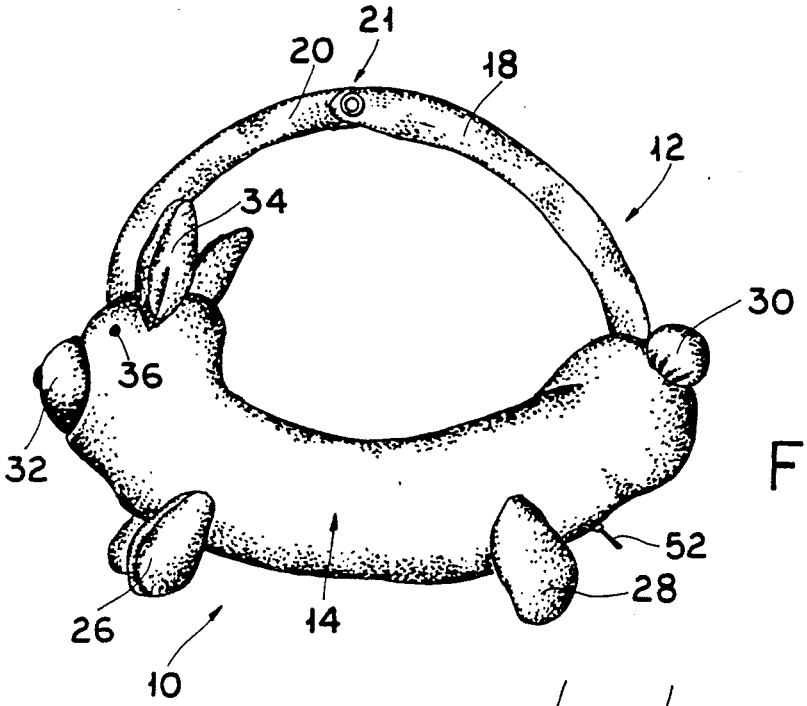
FIG. 1 is a side elevational view of the toy device of the present invention.

As mentioned previously, another component of toy device 10 is container 14, also formed of a flexible, washable fabric. Preferably, container 14 is made of a fabric that is a plush fabric or a fabric that has a nap. As seen in FIGS. 1, 2, 3, 4 and 6, container 14 is substantially tubular and elongated in shape, and desirably has a form which comprises the representation of an animal or other fanciful three-dimensional object. With reference specifically to FIG. 1, container 14 shown therein includes a pair of imitative front legs 26, a pair of imitative back legs 28, an imitative tail 30, as well as an imitative nose 32, a pair of imitative ears 34 and a pair of imitative eyes 36, all of these being formed from fabric and sewn to the body of container 14 in a conventional manner. These components of container 14 are decorative and not necessary to the function of the toy device.

Figure 5:
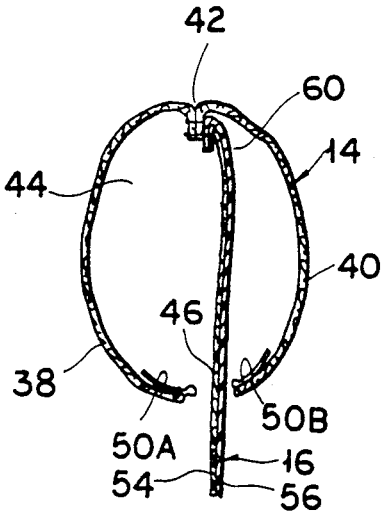
FIG. 5 is a cross sectional view of the toy device, taken along the line 5—5 of FIG. 4.
Figure 6:
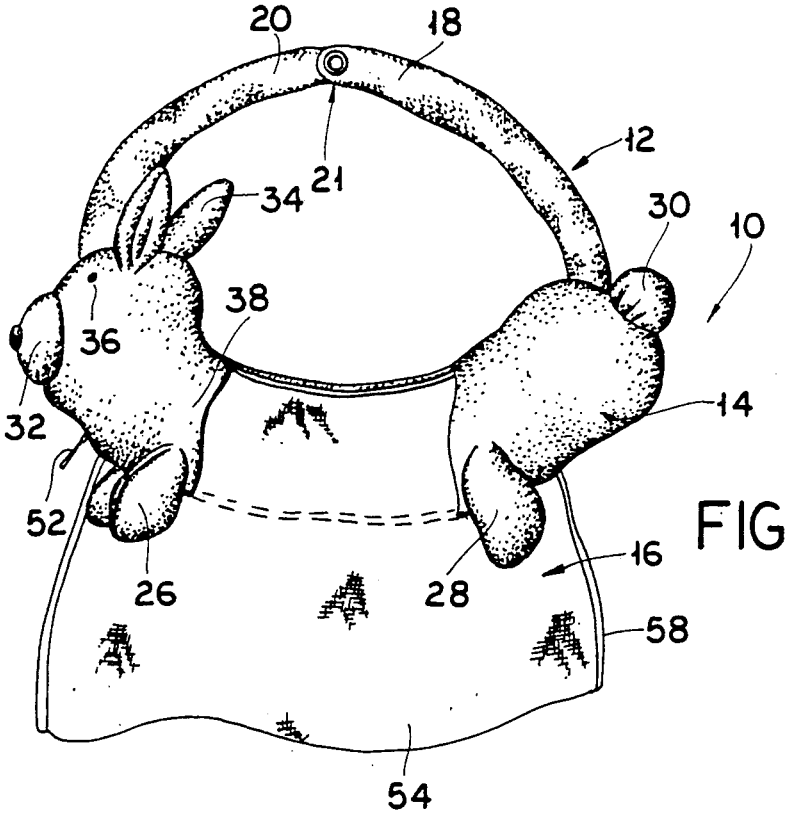
FIG. 6 is a enlarged side elevational view of the toy device of the present invention, with the middle portion thereof being broken away to reveal the extended bib more clearly.
Figure 7:
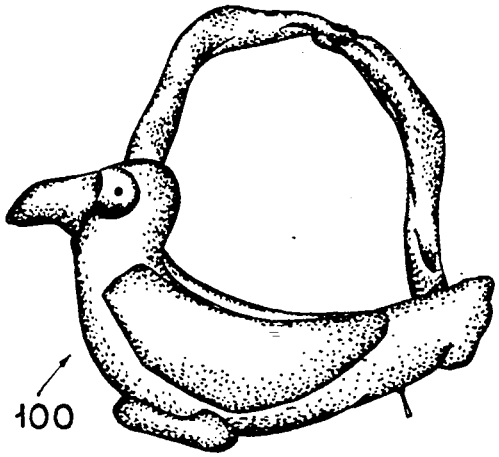
FIG. 7 shows another embodiment of the toy device of the present invention wherein the same is in imitation of the form of a bird.
Figure 8:
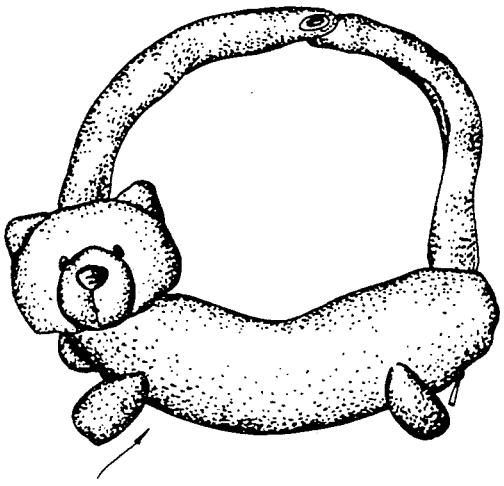
FIG. 8 shows another embodiment of the toy device of the present invention, this time imitating the form of a four legged animal such as a racoon.
Figure 9:
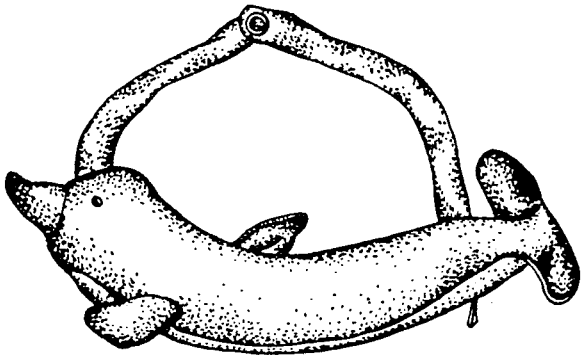
FIG. 9 shows another embodiment of the toy device of the present invention wherein the toy imitates the form of a fish.
Figure 10:
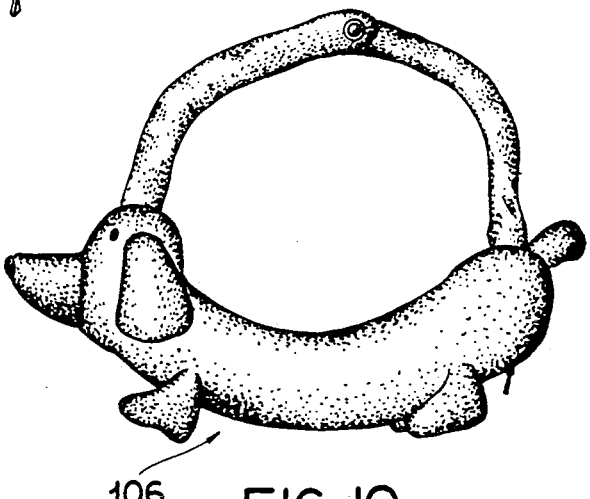
FIG. 10 shows another embodiment of the toy device of the present invention wherein the same imitates the form of a dog.
Figure 11:
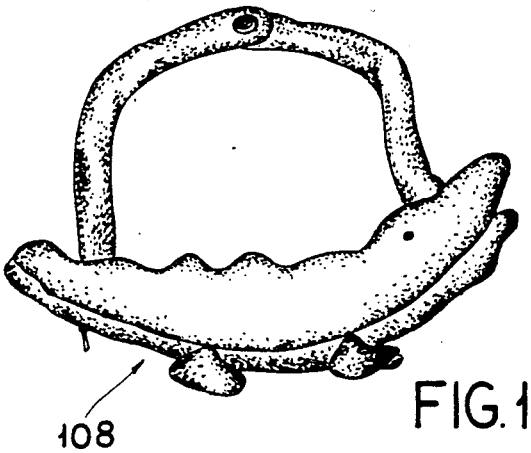
FIG. 11 shows still another embodiment of the toy device of the present invention wherein the same imitates the form of a reptile.

The tubular shape of container 14 is shown most clearly in FIGS. 5 and 6. Container 14 is formed from a curved front wall 38 and an oppositely curved rear wall 40. Walls 38, 40 are joined at their upper edges and sides by conventional stitching as shown at 42. It will be noted that stitching 42 runs from adjacent back legs 28 to tail 30, serves to attach the lower end of strap 18 to container 14, then passes by ears 34, serves to attach the lower end of strap 20 to container 14, passes by nose 32 and continues adjacent to the pair of front legs 26. Container 14 includes a hollow interior 44.

Figure 2:
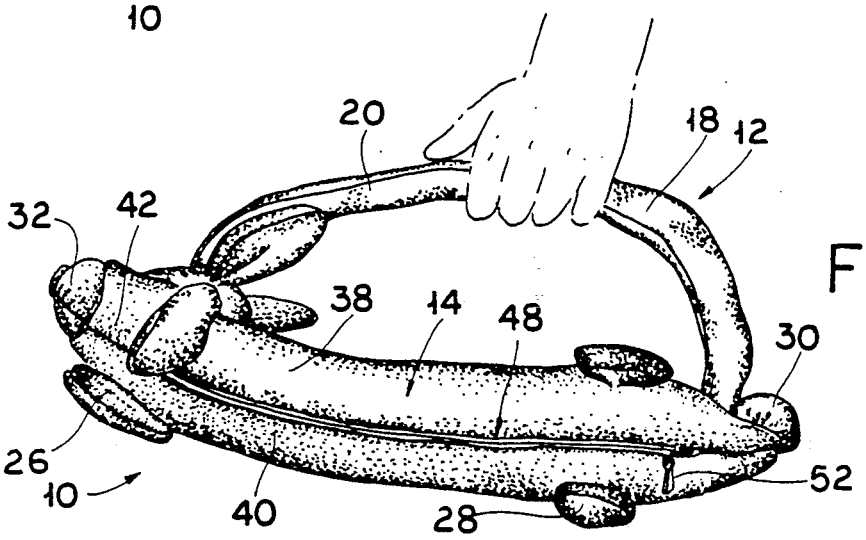
FIG. 2 is a side perspective view of the toy device of the present invention, the handle of the same being held by the hand of a young child and showing the zippered opening.
Figure 3:
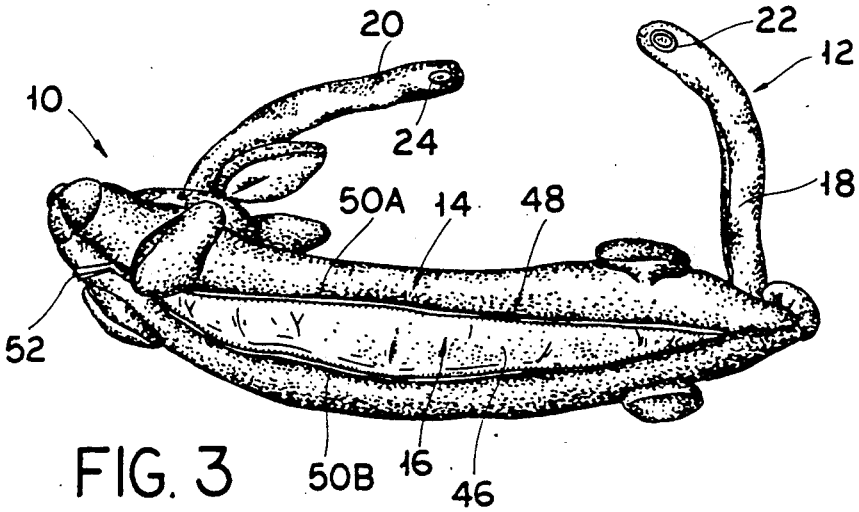
FIG. 3 is another side perspective view of the toy device of the present invention, similar to FIG. 2, but with the straps of the handle being opened and the zipper being in its open position to reveal the stored bib.

As clearly seen in FIGS. 2 and 3, container 14 has at its lower portion an elongated slit-like opening 46. Opening 46 runs from between front legs 26 to between rear legs 28, with opening 46 being generally parallel to the long axis of container 14. For the purpose of enabling selective opening and closing of the opening 46, there is provided a closing mechanism for opening 46. The closing mechanism is desirably in the form of a conventional zipper 48 which includes a pair of parallel zipper tapes 50A, 50B that cooperate with a zipper slider 52, enabling easy opening and closing of opening 46.

Bib 16 of toy device 10 is fixed within interior 44 of container 14 and can be easily rolled out of and reinserted into the container. Bib 16 comprises a front face 54, desirably made of terry material, and a rear sheet 56, desirably made of flat plastic, water resistant sheet material. Front face 54 and rear face 56 are joined by a trim 58 which surrounds the borders of front and rear faces 54, 56, and joins them, as by a line of sewing. Bib 16 has an upper end 60 (see FIG. 5) which is attached to interior 44 of the container 14 by stitching line 42 that also joins front wall 38 to rear wall 40 at the upper portion of the container 14. The length of bib 16, as seen best in FIG. 4, is preferably greater than its width, and the width of bib 16 is substantially the same as the length of opening 46.

Turning now to the use and operation cf toy device 10 of the present invention, the same is seen in its normal mode in FIG. 1, with the same appearing to a small child like a toy animal, imitated by the configuration of container 14. Container 14 has a handle 12 by which toy device 10 can be readily carried by a small child. Typically, the child's hand would grasp handle 12 at the middle section of the handle, as best seen in FIG. 2.

By way of setting forth the amusement and toy value of the toy device 10 of the invention, toy device 10 can be grasped by handle 12 by the hand of a child as that child is going with his parents from a home to a restaurant and will be affectionately treated by the child as a plaything.

At the restaurant, the parents and child may readily transform toy device 10 into a useful bib, enabling the child to eat or drink in a manner so as not to spoil or soil his or her clothes. To that end, straps 18, 20 are opened by detaching male snap 24 from the female snap 22, as seen in FIG. 3, and then re-positioning said straps about the neck of the child, as seen in FIG. 4. Thereafter snaps 22, 24 are reshaped to once again join straps 18, 20 together, thereby holding the container 14 about the neck of the child.

When straps 18, 20 are affixed about the neck of the child, or at an earlier time, zipper 48 may be opened by sliding slider 52 along tapes 50A, 50B, causing opening 46 to come into existence. At that time, bib 16 is exposed, as seen in FIG. 3, and may be readily unrolled from interior 44 of container 14 to an extended position, as seen in FIGS. 4 and 6. It will be noted that upper end 60 of bib 16, being attached to an interior portion of container 14, is retained in place, causing bib 14 to hang properly about the chest of the child, protecting the child's clothes from dirt, drink, food and spoilage.

When the child is finished eating or drinking, any food or drink can be removed from bib 16 by simply wiping the same off, and bib 16 can be readily rolled back into interior 44 of container 14. Then slider 52 can be used to close zipper 48, thereupon causing bib 16 to be completely contained once again within container 14. Also, now straps 18, 20 can be detached from about the neck of the child, and then rejoined so that the toy device resumes its initial position as shown in FIGS. 1 and 2, to be considered an amusing plaything by the child.

The child will soon realize that his or her bib is removably contained with the representation of an animal, and can be pulled out or restored therein as needed. Further, the child can be taught responsibility by being delegated the task of carrying the bib from the home to the restaurant, this responsibility being a pleasant task since the child is also carrying an amusing animal-like plaything.

FIGS. 7, 8, 9, 10 and 11 show other embodiments of similar structure, but here the container is imitative of a bird or a four-legged animal, such as a raccoon, a fish, a dog and an alligator, respectively, reference numerals 100, 102, 104, 106 and 108.

Thus, it is seen that the objects set forth above, as well as those made apparent from the preceding description, are attained by the invention, since changes may be made in the construction of the invention, without departing therefrom. It is intended that all matter contained in the description and shown in the drawing is merely illustrative and not limiting.

The following claims are intended to cover all general and specific features of the invention.

There is claimed:

1. A playmate and protector combination for an infant or child comprising:

a soft toy having an interior;

a handle for carrying the soft toy;

said handle sized and intended for fitting around the neck of an infant or child; and a sheet of material located within said soft toy having a portion thereof fixed to the interior of the soft toy, the soft toy having an opening and the sheet being selectively extendable through the toy opening outwardly therefrom such that said sheet is adapted to be located substantially over at least a substantial portion of the infant or child's torso when said handle is fitted around the neck of the infant or child.

2. A playmate and protector combination as set forth in claim 1, wherein the handle comprises a pair of straps, each of said straps having a fixed end and a second end.

3. A playmate and protector combination as set forth in claim 2 wherein the straps are attached at said fixed end to the container.

4. A playmate and protector combination, wherein said straps are selectively attachable to each other at said second ends.

5. A playmate and protector combination as set forth in claim 2, wherein the straps are attached to each other by a snap.

6. A playmate and protector combination as set forth in claim 1, wherein the soft toy is cylindrical in shape.

7. A toy device as set forth in claim 6, wherein said cylindrical shaped container has a longitudinal axis and said opening of said soft toy is parallel to said longitudinal axis.

8. A toy device as set forth in claim 1, wherein the container is elongated and cylindrical in shape.

9. A toy device as set forth in claim 1, wherein the container comprises an imitation of an animal body.

10. The playmate and protector combination of claim 1, wherein said handle includes attachment means for separating said handle then for closing the handle when said handle is fitted around the neck of the infant or child.

11. A playmate and protector combination as set forth in claim 1, wherein said soft toy has a first outer surface and second opposite outer surface, said handle being attached to the soft toy along said first outer surface and said opening being located along said second outer surface.

12. A playmate and protector combination as set forth in claim 1, further including means for selectively closing the opening.

13. A playmate and protector combination as set forth in claim 12, wherein the closing means comprises a zipper.

14. A toy device as set forth in claim 8, wherein the sheet of material fixed to the soft toy has an end attached to the soft toy.

15. A playmate and protector combination as set forth in claim 14, wherein the soft toy is formed from plush fabric and the end of the sheet of material is sewn to such fabric.

16. A playmate and protector combination as set forth in claim 15, wherein said end is sewn along a seam line of the plush fabric.

17. A playmate and protector combination as set forth in claim 1, wherein the width of the sheet of material is substantially the same as the length of the opening.

18. A playmate and protector combination as set forth in claim 1, wherein the sheet of material comprises overlapping joined sheets of terry material and plastic sheeting.

19. A playmate and protector combination as set forth in claim 1, wherein the sheet of material is rollable into and out of the soft toy through the opening.

20. A playmate and protector combination as set forth in claim 1, wherein the length of the sheet of material is greater than its width.

21. A playmate and protector as set forth in claim 1, wherein the soft toy and sheet of material are formed of washable fabric.

22. A playmate and protector combination for an infant or child comprising:

a soft toy having an interior;

a strap with attachment means for closing the strap connected to the soft toy, said strap sized and intended for fitting around an infant or child's neck;

a sheet of material having a portion fixed to the inside of the soft toy and extending through an opening in the soft toy outwardly from the soft toy so that said sheet is adapted to be located substantially over at least a portion of the infant or child's torso when the the strap is fitted around the neck of the infant or child, said sheet being selectively insertable within said soft toy through said opening.

23. The playmate and protector combination of claim 22, wherein said strap comprises a pair of strap members selectively attachable to each other.

24. The playmate and protector combination of claim 22, wherein the soft toy is in the shape of an animal body.

25. The bib assembly of claim 22, further including means for selectively closing the opening.

26. A method for utilizing a playmate assembly as a bib assembly comprising:

extending a sheet of material having a portion fixed within a soft toy of the playmate assembly through an aperture of the soft toy outwardly therefrom; and placing a handle attached to the soft toy around the neck of a child so that said sheet is placed below said child's head and over at least a portion of the child's torso.

27. The method of claim 26, further including the step of opening the aperture of the soft toy prior to said extending step.

* * * * *